United States Patent [19]

Hartmann

[11] Patent Number: 4,457,124

[45] Date of Patent: Jul. 3, 1984

[54] BAG-PACKAGING MACHINE FOR BREAD

[76] Inventor: Johannes Hartmann, 40, Lange Strasse, D-4795 Delbrück, Fed. Rep. of Germany

[21] Appl. No.: 299,250

[22] Filed: Sep. 3, 1981

[30] Foreign Application Priority Data

Jul. 24, 1981 [DE] Fed. Rep. of Germany ..... 3129205

[51] Int. Cl.[3] ..... B65B 31/06

[52] U.S. Cl. ..... 53/512; 53/571; 53/572; 53/370; 53/266 R

[58] Field of Search ..... 53/459, 434, 469, 471, 53/483, 79, 512, 570, 571, 572, 370, 227, 566, 266, 458, 467, 468; 198/487, 740

[56] References Cited

U.S. PATENT DOCUMENTS

| | | | |
|---|---|---|---|
| 1,039,785 | 10/1912 | Nevill | 198/740 |
| 3,333,674 | 8/1967 | Homan | 198/487 X |
| 3,492,780 | 2/1970 | Bastasch | 53/572 X |
| 3,516,222 | 6/1970 | Klenz | 53/79 |
| 3,603,269 | 9/1971 | Royer | 198/487 X |
| 3,656,274 | 4/1972 | Vind | 53/370 X |
| 3,945,171 | 3/1976 | Marietta et al. | 53/79 |
| 3,971,191 | 7/1976 | Hoyland | 53/512 |
| 4,188,769 | 2/1980 | Bright | 53/434 |

FOREIGN PATENT DOCUMENTS

| | | | |
|---|---|---|---|
| 1036748 | 8/1958 | Fed. Rep. of Germany | 53/512 |

*Primary Examiner*—Nicholas P. Godici
*Assistant Examiner*—M. Jordan
*Attorney, Agent, or Firm*—William A. Drucker

[57] ABSTRACT

A bag-packaging machine has a conveying device (3) for transporting whole loaves (1) in the direction of a bundle of bags (4), a suction unit (12) which in each case opens the top bag (4*a*) of the bundle of bags (4), two spreaders which reach into the opened bag (4*a*) and hold the latter in the opened position, a pusher (18) which moves the whole loaf (1) into the ready-held bag (4*a*) and a bag-sealing device (15). The pusher (18) is constructed as a suction unit and has at its end a suction head (19/20) which conveys the whole loaf (1) into the opened bag (4*a*) and sucks a vacuum, drawing the neck of the bag (4*b*) tightly to itself after removal of the spreaders (13), thus holding the whole loaf (1) automatically and pushing it in this position as far as the sealing device (15). In accordance with a process for operating with this machine, the air is sucked out of the bag (4*a*) to such an extent that the bag (4*a*) presses tightly round the whole loaf (1) and the latter is held firmly against a change of position in the bag (4*a*).

8 Claims, 8 Drawing Figures

BAG-PACKAGING MACHINE FOR BREAD

The invention relates to a bag-packaging machine, specifically for whole loaves, with a conveying device for transporting the whole loaves in the direction of a bundle of bags, a suction unit which in each case opens the top bag of the bundle of bags, two spreaders which reach into the opened bag and keep the latter in the opened position, a pusher which moves the whole loaf into the ready-held bag, and a bag-sealing device. It also relates to a process for packaging bread.

With all known packaging machines of this type, the pusher or several pushers are moved by means of an endless revolving roller-chain in the direction of the loaf packaging and then, depending on the design-related options, moved up by means of points in the vicinity of the roller-chain's return position. With the straight line process, after taking over the loaf from the conveying device, the pusher(s) convey(s) the loaf into the opened bag.

After the pushing open of the bottom of the bag by the packaged goods (whole loaf), the bag is removed by the spreaders and carried to a feeder belt and to the sealing machine running at right angles to the direction of packaging, or to a sealing device connected in series in the direction of packaging.

In the models with a sealing device connected in series in the direction of packaging, various stops are used, to deliver the packaged goods (whole loaf) in a suitable manner for sealing. These stops must always be adjusted to the particular sizes—length and width respectively, of the packaged goods. After pushing the filled bag onto the feeder belt running at right angles, or into the sealing device connected in series, the pusher immediately swings upwards out of the bag. Due to the design, this results in an unalterable very disadvantageous contact with the neck of the bag, brought about by the revolving process (roller-chain/pusher), so that, as a result, displacement of the bag with the loaf or damage to the bag is sometimes unavoidable, these fluctuations in the height of the pusher being very disadvantageous for good packaging.

A further disadvantage is that the loaf is lying loosely in the bag when packaged by the sealing device because, after the seal has been applied, the bag still fits loosely round the loaf, and consequently an unfavourable movement (displacement/wobbling) of the loaf in the sealed bag is produced, which gives the packaging an unattractive appearance and is not good enough for to-day's packaging technology, because there is a comparatively large amount of air in the bag.

As a result of the necessary longitudinal stop, the packaged loaf cannot be carried away in the direction of movement as hitherto, but a lateral movement must take place here by means of an extra device.

Laterally fitted stops, e.g. pneumatically controlled pressing-on jaws, permit to ensure the removal of the filled and sealed bag in the direction of movement, but have the disadvantage that they must be very precisely adjusted, since otherwise packaged goods sizes (e.g. whole loaves), which have varying dimensions, are deformed by the pressing-on jaws, or slip in between these. It is the main object of the present invention, while avoiding the above-mentioned deficiencies, to produce a bag-packaging machine of the type referred to hereinabove, with which the loaf can be packed firmly wrapped by the bag in a simple and effective way. Simply constructed, automatically operating means, which treat the loaf gently, should be provided for this packaging design.

A further object of the invention is to construct the packaging machine in such a way that with it, apart from inserting appropriate bags, whole loaves in different sizes and lengths, and also cut loaves in vertical or horizontal arrangement can be firmly wrapped and packed by the bag, without conversion of the machine being necessary.

A still further object of the invention is to package and remove the loaves in a straight line passage.

Yet another object consists in producing a process which is simple and rational, as well as easy on the packaged goods, for the stable packaging of the loaf in bags. These objects are achieved, according to the invention by providing a bag-packaging machine, specifically for whole loaves, with a conveying device for transporting the whole loaves in the direction of a bundle of bags, a suction unit which in each case opens the top bag of the bundle of bags, two spreaders which reach into the opened bag and hold the latter in the opened position, a pusher which moves the whole loaf into the ready-held bag, and a bag-sealing device, characterised in that the pusher is constructed as a suction unit and is fitted at its end with a suction head which conveys the packaged goods (whole loaf) into an opened bag and sucks a vacuum, pulling the neck of the bag firmly to itself after removal from the spreaders, thus holding the packaged goods automatically and pushing them in this position as far as the sealing device connected in series.

Further, according to the invention, there is provided a process for the packaging specifically of whole loaves, characterised in that packaged goods (whole loaf) are transported by means of a pusher formed as a suction unit and fitted with a suction head at its end, into an opened bag, and the air present is sucked out of the bag to the extent that the latter presses tightly against the packaged goods, the neck of the bag after removal of spreaders being drawn tightly against the suction head and as a result the packaged goods are automatically held and pushed in this position as far as a sealing device connected in series, whereat the packaged goods are held back by means of a stripping device and the suction head is withdrawn from the neck of the bag horizontally without a swivelling movement during the return.

The following advantages are achieved with the bag-packaging machine according to the invention:

1. by means of the suction head, fitted to the pusher, the bag is pulled round the loaf tautly and the air present in the bag is largely sucked out, so that, after sealing, the bag, the load is firmly wrapped by the bag and cannot move to and fro in the bag—i.e. optimum packaging;
2. as a result of the also rotating suction head, the taut bag wrapping is still further improved, since the bag neck is twisted before sealing and, as a result, the bag lies optimally firmly around the loaf;
3. the suction head which travels into the bag applies a certain pressure to the loaf; essentially however it pulls the bag over the loaf and holds both parts (bag and bread) firmly and pushes them jointly, so that a careful loaf-packaging takes place;
4. since the suction head, during the process, holds the bag firmly round the loaf as far as the sealing device, and the loaf consequently always presses against the bottom of the bag, no stop (as hitherto)

is required in the direction of passage, since the mobile suction head itself represents the abutment and the pusher unit. As a result, different length whole loaves can be packaged in appropriate bags without converting the machine;

5. since no stop is required for the loaf to be pushed in, the packaged loaf can also be conveyed away in the direction of passage hitherto in a straight line, which considerably simplifies the removal of loaves;
6. The suction head, movably mounted on the pusher and able to swivel vertically travels into the neck of the bag in a straight line and also out of the neck of the bag in a straight line, and only then is the swivelling movement upwards carried out, so that the following loaf cannot be held back by the pusher and subsequently again grasped for inserting. As a result of this straight line in and out travelling movement, an undesirable opening or damaging of the bag neck is avoided, and no packaging errors take place;
7. as a result of the pusher with a suction head, not only whole loaves of different lengths, but also cut loaves in vertical or horizontal arrangement can be stably packed in the bag—the vacuum effect makes possible near vaccum-packaging;
8. the suction head is simply assembled and is fitted to the pusher designed as a suction lead, the pusher's pivot shaft also forming a suction lead—consequently the mechanical facilities have simultaneously been optimally exploited for the suction effect, i.e. an advantageous technical solution;
9. the movement control of the pusher with suction head has been carried out by means of simple and reliable means;
10. the complete packaging machine has a simple, reliable and efficiently operating design and ensures in the passage process optimum implementation of packaging for loaves of the most different types—it can however also be employed for packaging other consumable goods.

An embodiment is hereinafter described in detail below with reference to the accompanying drawings, wherein.

Figure 1:
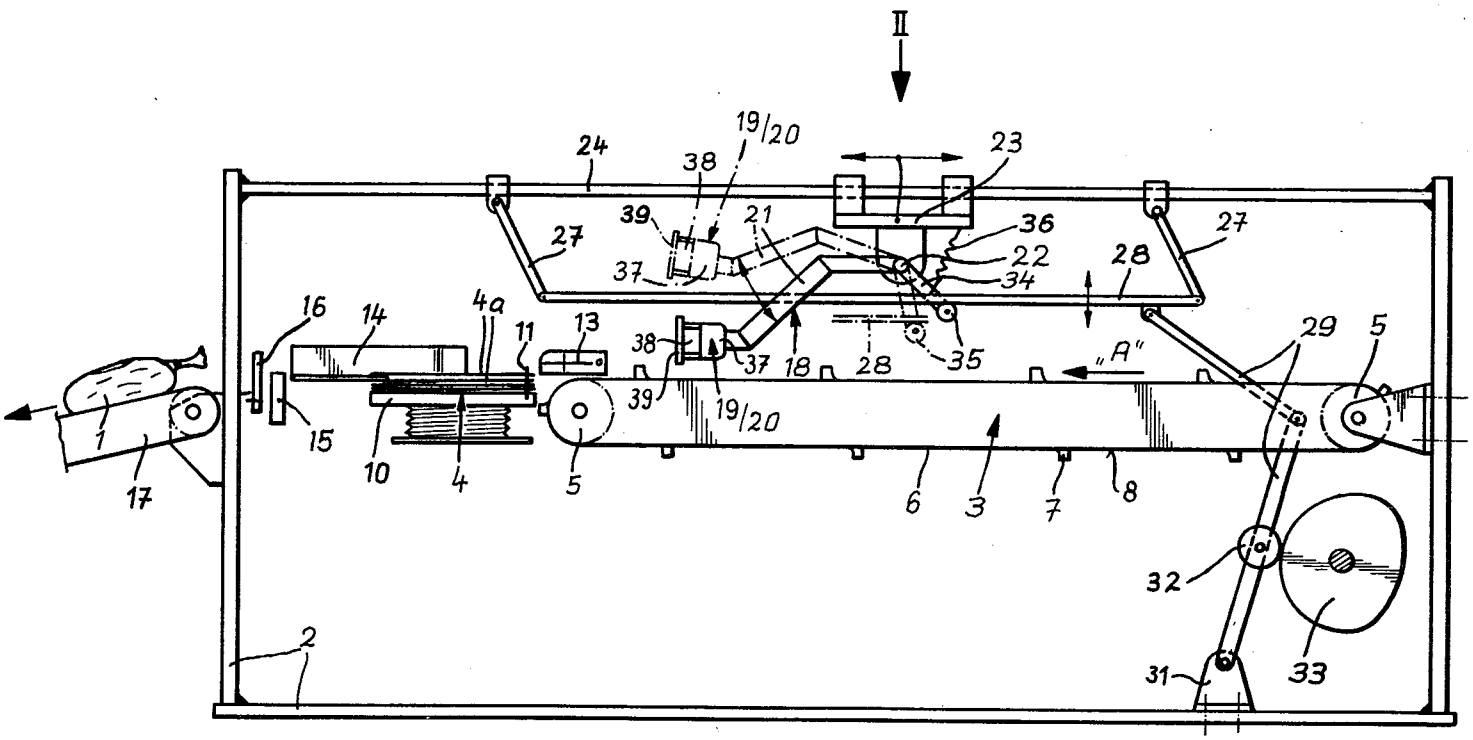
FIG. 1 is a side elevation of a bag-packaging machine for bread.

The bag-packaging machine, specifically for whole loaves 1, has in a machine frame 2 a conveying device 3 running in an horizontal plane for the conveyance of the whole loaf 1 in the direction of a bundle of bags 4. This conveying device is formed by, for example, two endless chains or belts 6 with drivers 7 running round return wheels or rollers 5 at a distance from one another, a support surface 8 located between the chains or belts 7, and lateral guides 9. The wheels or rollers located in a return area 5 are motor-driven.

The bundle of bags 4 adjoins in the loaf passage direction (arrow "A") the conveying device's return area and rests on a sprung support pad 10. The bundle of bags 4 consists of a large number of individual bags 4*a* lying on top of one another, which are jointly held on support pad 10 in retaining pins 11, clamps or other holding device. The bags 4*a* are preferably made of plastic.

A suction unit 12 (cf. FIG. 2), secured to the machinery framework 2 and arranged in the vicinity of the bundle of bags 4, works in each case with the top bag 4*a* and opens the latter by suction air. This suction unit 12 can swivel up and down for opening bags and acts from above in each case on the bag 4*a* lying on top. In the passage direction "A", in front of the bundle of bags 4, there are arranged two spreaders 13 which can swing apart and are designed to be adjustable in height, e.g. they are secured to the conveying device 3, and adjoin the lateral guides 9 in the passage direction "A". These two spreaders 13 enter into the bag 4*a* held open by the suction unit 12 and hold it in the open position, i.e. open in the width and height directions for the loaf 1 to run into it. Adjoining the bundle of bags 4 in the passage direction "A" there is a support and lateral guide 14 and behind it, supported on the framework 2, a bag-sealing device 15 with a clipping device.

After this sealing device 15 there are provided laterally swivelling scrapers 16 on the framework 2, the mode of operation of which will be explained later in the functional description. Finally, on the framework 2 in the passage direction "A" there is a remover-belt 17, a chute or such like for the packaged loaves.

The loaves 1 are individually moved, each into an opened bag 4*a*, by means of a pusher 18 arranged above the conveying device 3 and moving backwards and forwards in the conveying direction "A", and pushed as far as the sealing device. This pusher 18 is fitted with a suction head 19/20 at its free pushing end which projects into the opened bag 4*a*, in doing so pulls the flexible and/or elastic bag 4*a* firmly round the loaf by means of the suction air, and in this position pushes the loaf 1 with bag 4*a* to the sealing device 15.

The pusher 18 has a pushing and swivelling arm 21, made out of circular or square cross-section tube, multi-angled in the vertical plane (height direction) and preferably designed in an obliquely lying S mode. This pushing and swivelling arm 21 is journelled at its end away from the suction head 19/20 so as to be able to swivel vertically round an horizontal swivelling shaft on a carriage 23, this carriage being movably journalled on guides 24 of the machine framework 2, able to move against the passage direction "A". The displacement movement of the carriage 23 in both directions (arrows in FIGS. 1 and 2) results by motor through a drive 25, such as lever rods with pitch cam, rack moved by a motor, or pressure agent cylinder.

The hollow pushing and swivelling arm 21 is continued as a suction passage in its also hollow swivelling shaft 22, and this swivelling shaft 22 is connected, with its long end away from the pushing and swivelling arm 21, with a suction device (not shown) via a suction lead or a suction pipe 26.

The vertical swivelling of the arm 21 with suction head 19/20, which is independent of the packaging movement, takes place through a lifting beam 28 held at the guides and vertically movable by articulated levers 27, in conjunction with a control rod 29. The articulated levers 27 are held at one end, able to swivel but fixed in position, at the guides 24 and accommodated in their own (lower) ends the lifting beam 28 articulatedly in both its long ends.

The control rod 29 is swivellingly journalled at one end at the lifting beam 28. The rod, which is itself articulated, is held with its other long end at the framework 2 in the swivelling bearing 31.

The control rod 29 runs with a control roller 32 to a pitch cam 33 which can be rotated by motor and is rotatably journalled at the framework 2, the lifting movement of the lifting beam being determined by the cam.

A lever 34 is rigidly fixed to the swivelling shaft 22 or the arm 21, the lever having a sensing roller at its free end, with which it presses up against the underside of the lifting beam 28 and, by means of a tension spring, 36, the one end acting on lever 24 and the other end on the carriage 23, is held under tension. By the up and down movement of the lifting beam 28, the swivelling movement of the arm 21 is brought about through the lever 34 with sensing roller 35.

The suction head 19/20 is made up of a hollow body 37 with suction openings 38 in the casing sides and an end pressure plate 39, and is rigidly or swivellingly attached to the arm 21.

The packaging of a whole loaf 1 into a bag 4*a* takes place as follows:

The whole loaves 1 are carried on the conveying device 3 in the direction of the arrow "A" to the bundle of bags 4. During this conveying movement, the suction unit 12 opens the top bag 4*a* by means of suction air and then the spreaders 13 project into the opened bag 4*a* and hold it open.

The first loaf to be packaged now arriving is pushed by the conveying device 3 in between the spreaders 13 and partially into the opened bag 4*a*.

The pushing and swivelling arm 21 has by then already swung down and followed the loaf 1 for a certain distance and it now acts with its pressing plate 39 on the loaf 1 and pushes it further into the bag 4*a*, right to the bottom of the bag. At the same time the holder 11 releases the bag 4*a*, and the suction head 19/20 is in the region of the neck of the bag.

Immediately after the spreaders 13, the arm 21 is supplied with suction air, as a result of which the suction head 19/20 sucks the air out of the bag 4*a* through its suction openings 38, the bag 4*a* being firmly (tautly) wrapped round the loaf 1 and the neck of the bag 4b also lying firmly round the suction head 19/20.

As a result of this sucking action, the loaf 1 lies firmly against the bottom of the bag in the longitudinal direction and the bag 4*a* is drawn around the loaf 1, practically vacuum packed. In this position the suction head 19/20 has taken over the loaf 1 with the bag 4*a*, i.e. the further conveying movement of the loaf 1 with the bag 4*a* takes place by means of the arm 21 with suction head 19/20, and the loaf 1 is pushed through by the arm 15 in the direction of the sealing device 15 between the guides 14. With fairly small loaves 1, as a result of the sucking force, a floating movement of the loaf 1 is possible, since the bag 4*a* is firmly held at the suction head 19/20 and is consequently carried.

If the loaf 1 has been pushed so far that the scrapers 16 lie between the end of the loaf and the suction head 19/20, these scrapers 16 become active in that they swivel towards each other at right angles to the passage direction "A" and then hold the bag 4*a* between them in front of the pressure plate 39 in the region of the neck.

By means of the retreating suction head 19/20 with the neck of the bag sucked on tightly, the filled bag 4*a* is pulled firmly up against the scrapers 16 against the direction of conveyance of the loaf so far, and it is thus always in an optimum sealing position since, while the suction head 19/20 is withdrawn from the neck of the bag 4*b*, the pressing jaw of the sealing device 15 is lowered between the packaged goods (whole loaf 1) and the retracting suction head 19/20 on to the sucked together neck of the bag 4*b*, and takes over the latter for the sealing operation. The interplay of this function ensures not a chance but a deliberately enforced precise and taut packaging.

While the scrapers 16 come into their working position and between them hold the bag 4*a* in the neck region 4*b*, the suction head 19/20 leaves the bag 4*a* in the opposite direction to the passage direction "A" and the bag sealed with a clip or such like can then leave the packaging machine with the packaged loaf 1 via the removal device 17.

Figures 2, 8:
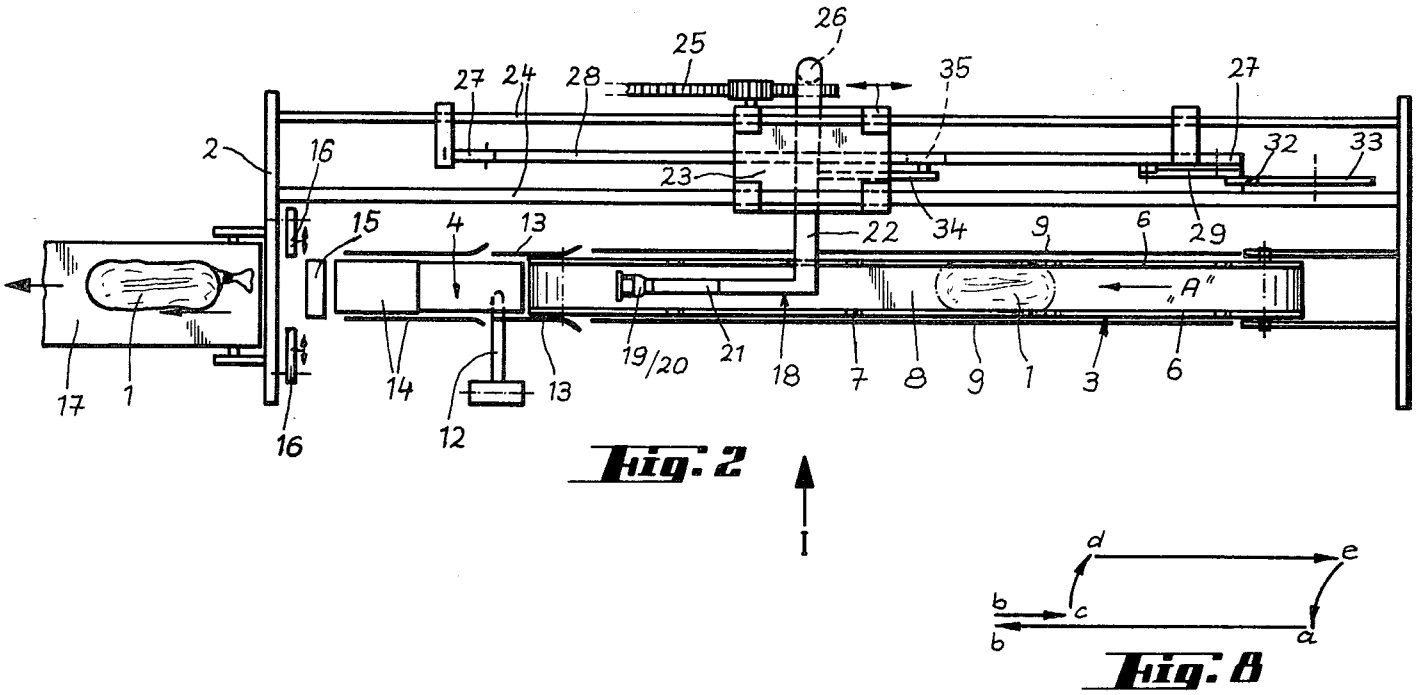
FIG. 2 is a plan view of the same packaging machine.

The movement travel of the arm 21 with the suction head 19/20 is shown in FIG. 8. In the packaging direction the suction head 19/20 moves in a straight line in the horizontal plane from a to b, retaining this straight line course also when entering into the bag 4*a* and when pushing the bag 4*a* to the sealing device 15 and the scrapers 16 respectively. Point b is located in the region of the scrapers 16. When the scrapers have taken over the bag 4*a*, the suction head 19/20 again travels horizontally and in a straight line out of the bag 4*a* from b to c. The suction head 19/20 swings up outside the bag 4*a* from point c to d and travels back a specific distance from d to e in the swivelled upwards position. It can then swivel down again from e to a, to act on a loaf 1 to be packaged next. This pattern of movement of the suction head 19/20 is determined through the lifting beam 28 with control rod 29 and pitching cam 33 via the arm 21 with spring-loaded lever 34 and sensing roller 35.

Figure 3:
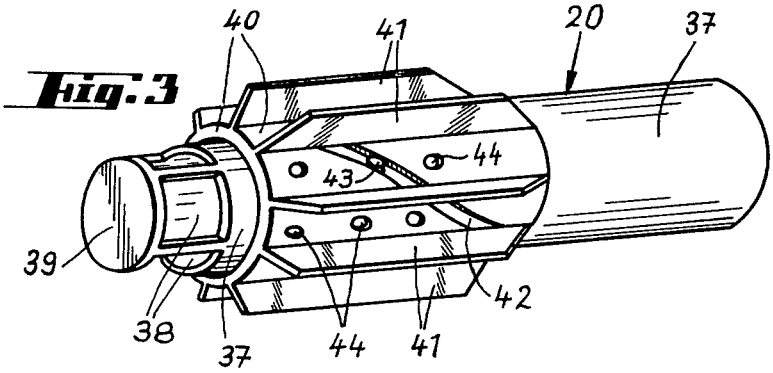
FIG. 3 is a perspective view of a suction head of the packaging machine, designed to rotate.

In FIG. 3 of the drawing the suction head 20 is designed rotatable in itself, to improve the almost vacuum seal of the bag 4*a*. For this the hollow body 37 is developed as a suction tube which is mounted rigidly or removably on the arm 21. At its packaging side end the suction tube 37 shows the pressure plate 39 and the suction openings stretching behind it in the casing side of the suction tube 37. Rotatable about this suction tube 37 is a rotating head 40 with radially spreading fins 41, preferably journalled so that its rotation is limited in both directions of rotation, this rotating head 40,41 is mounted loosely round the suction tube 37. The rotation of the rotating head 40, 41 is implemented in a preferred manner forcibly by means of a pushing movement of the suction tube 37, in that at least one helical running groove 42 is removed from the rotating head 40, in which a projection 43 of the suction tube (or vice versa) engages. In the rotating head 40 suction holes 44 are removed between the ribs or fins 41, which can also be formed as slots.

The operation of this rotatable suction head 20 is explained below with reference to FIGS. 4 to 7.

Figure 4:
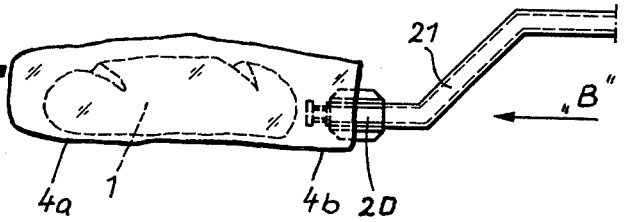
FIGS. 4 to 7 are side elevations of the individual packaging operations made by the suction head, from the position in which the loaf is pushed into a bag, up to the sealed bag position.
Figure 5:
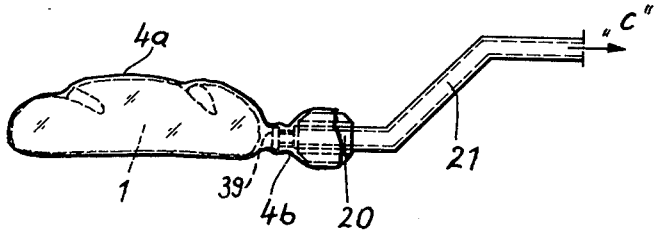

The loaf 1 is pushed into the opened bag 4*a* as previously described. FIG. 4 shows the suction head 20 during its travel into (cf. arrow "B") the opened bag 4*a*. The subsequent suction takes place as in FIG. 5, while the arm 21 is subjected to the suction effect (cf. arrow "C"), so that the bag 4*a* is drawn tightly over the loaf 1. The arm 21, acting as suction tube is then withdrawn against the conveying direction "A" in the direction of the arrow "D", as in FIG. 6, and in doing so the rotating of the suction head 40 about its longitudinal axis takes place, which is carried out by means of the rotating head 40 which rotates about the suction head tube 37.

Figure 6:
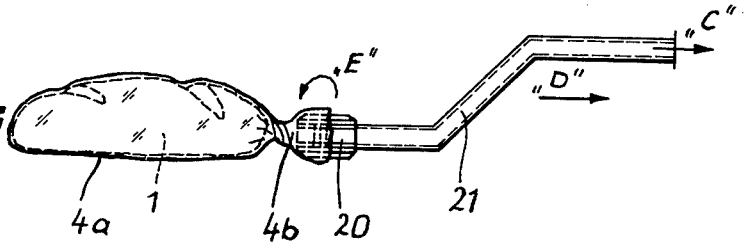

Since, as a result of the suction effect, the neck of the bag 4b has also been sucked between the fins 41 on to the rotating head 40, now by the withdrawal of the suction head 20 in the direction "D", rotation of the rotating head is introduced automatically and forcibly by the groove-projection guide 42, 43, and as a result the neck of the bag 4b is twisted together (cf. arrow "E" in FIG. 6). When the neck of the bag has been twisted together, the pressing jaws of the sealing device 15 come together and hold the twisted neck of the bag 4b firmly, and sealing begins.

Figure 7:
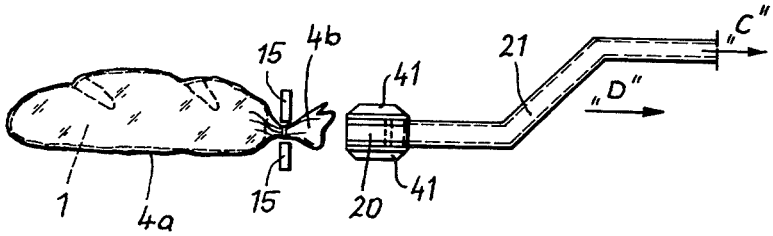

The sealing device 15 interrupts by means of its pressing jaws the suction flow in the region of the neck region 4b of the bag 4a lying round the rotating head 40, and the suction head 20 can then be removed from the neck of the bag (cf. arrow "D" in FIG. 7).

Subsequently the rotating head 40 rotates again by spring power, as a result of the suction flow or suck line back to its starting position.

I claim:

1. In a bag packaging machine for a food item, having:

(a) a machine structure (b) a support means on said structure for a stack of unopened bags (c) a conveyor means on said structure for conveying a food item along a linear conveyor path towards said support means (d) a suction device on said structure positioned adjacent to said stack support means and operable to open an uppermost bag of said stack (e) spreader means on said structure positioned adjacent to said stack support means and including at least one spreader to enter an opened bag and retain the bag in opened condition (f) pusher means carried movably on said structure and movable along said conveyor path to contact a food item thereon and push it into an opened bag, said pusher means including a suction head positioned to enter the bag, said pusher means being pivotable into and out of said conveyor path, (g) bag sealing means on said structure for sealing a bag containing a food item, the improvement which comprises, in combination, (i) said conveyor means is an endless conveyor belt terminating at a downstream end adjacent said stack support means, (ii) said spreader means comprises two spreader arms pivotable towards and away from each other in a direction transverse to said conveyor path (iii) said pusher means is pivotable vertically into and out of said conveyor path about a horizontal axis transverse to said conveyor path, said pusher means being also translatable parallel to said conveyor path, said pusher means being arranged to pivot from a starting point downwardly to a position at the rear of a food item on said conveyor path, thereafter to move along said path to push the food item into an opened bag, thereafter to push the bagged food item along said conveyor path beyond said spreaders to said sealing means, thereafter to return along said conveyor path, thereafter to pivot upwardly out of said conveyor path, and thereafter to return further along parallel to said conveyor path to said starting point, and said suction head being operable to apply suction when said bagged food item has passed beyond said spreaders and to terminate said suction when said bagged food item has been sealed by said sealing means.

2. A bag packaging machine, as claimed in claim 1, comprising guide means on said machine structure disposed parallel to said conveyor path, a carriage movable along said guide means, drive means acting between said machine structure and said carriage for moving said carriage alternately in each direction along said guide means, a suction pipe journalled in said carriage for rotation about a horizontal axis transverse to said conveyor path, and a hollow arm mounted at a first of its two ends on said suction pipe and lying along said conveyor path, said pusher means being mounted on the second of said ends of said hollow arm.

3. A bag packaging machine, as claimed in claim 2, comprising control means on said machine structure for causing upward and downward pivoting of said pusher means, said control means comprising a sensing lever extending radially from said suction pipe, a lifting arm mounted on said machine structure by pivoted levers and disposed parallel to said conveyor path, said lifting arm being displaceable upwardly and downwardly with respect to said conveyor path whilst remaining parallel thereto, said lifting arm abutting said sensing lever, and power operated means on said machine structure coupled to said lifting arm for moving said lifting arm upwardly and downwardly.

4. A bag packaging machine, as claimed in claim 3, wherein said power operated means comprise an edge cam rotatably mounted on said machine structure, a control rod pivotably mounted by a first of its two ends on said machine structure, a link connecting the second end of said control rod to said lifting arm, and a cam follower on said control rod intermediate its ends, said cam follower contacting said edge cam.

5. A bag packaging machine, as claimed in claim 2, wherein said suction head comprises a head member rotatably mounted on said hollow arm for rotation about an axis parallel to said conveyor path, and wherein means are provided for rotating said head memmber, whilst within said bag and whilst suction is being applied, thereby to form a twist in said bag.

6. A bag packaging machine, as claimed in claim 5, wherein said suction head comprises a stationary tubular portion connected with said hollow arm, said tubular portion including means defining suction openings in its wall, said tubular portion having at its leading end, in the conveying direction, a pressure plate for abutting a food item to be pushed into a bag, a tubular head with radial fins rotatable and longitudinally slidable on said tubular portion, said head including means defining suction openings therein to communicate with said suction openings of said tubular portion, said tubular head including means defining a helical groove, said tubular portion having a projection engaged in said helical groove for causing said head to rotate as it is moved longitudinally with respect to said tubular portion.

7. A bag packaging machine, as claimed in claim 1, comprising scraper means mounted on said machine structure in alignment with said conveyor path and beyond said sealing means in the direction of conveying, said scraper means being reciprocable transversely with respect to said conveyor path for moving into gripping engagement with a neck portion of a bag containing a food item, whilst said suction head is applying suction thereto, said bag sealing means acting on said neck portion at a position thereof between said scraper means and said suction head.

8. A bag packaging machine, as claimed in claim 1, comprising a package-removing means disposed in alignment with said conveyor path and beyond said sealing means, in the direction of conveying, to receive a sealed bag containing a food item.

* * * * *